US005926443A

United States Patent [19]

Kitaura

[11] Patent Number: 5,926,443

[45] Date of Patent: Jul. 20, 1999

[54] PENDULUM DEVICE

[75] Inventor: Hiroharu Kitaura, Tokyo, Japan

[73] Assignee: Seiko Clock Inc., Japan

[21] Appl. No.: 08/751,110

[22] Filed: Nov. 15, 1996

[30] Foreign Application Priority Data

Nov. 17, 1995 [JP] Japan ..... 7-299552

[51] Int. Cl.[6] ..... G04B 15/00; G04B 19/00

[52] U.S. Cl. ..... 368/165; 368/179; 368/223

[58] Field of Search ..... 368/76, 88, 134–138, 368/165–155, 179–183, 223, 276

[56] References Cited

U.S. PATENT DOCUMENTS

| | | | |
|---|---|---|---|
| 4,228,533 | 10/1980 | Siefert | 368/134 |
| 4,508,456 | 4/1985 | Hepfer et al. | 368/262 |
| 4,829,495 | 5/1989 | Kaneko et al. | 368/134 |
| 5,446,704 | 8/1995 | Chen | 368/134 |

FOREIGN PATENT DOCUMENTS

| | | |
|---|---|---|
| 61-36950 | 4/1985 | Japan . |
| 62-47106 | 3/1986 | Japan . |
| 5-40471 | 1/1993 | Japan . |

*Primary Examiner*—Vit W. Miska
*Attorney, Agent, or Firm*—Adams & Wilks

[57] ABSTRACT

A pendulum device comprises a pendulum rod, a support member for rockably supporting the pendulum rod to permit the pendulum rod to swing freely within a normal swinging angle, and a locking mechanism mounted on the support member for relative movement between first and second positions. The locking mechanism is operative in the first position to lock the pendulum rod from swinging freely and is operative in the second position to enable the pendulum rod to swing freely within the normal swinging angle.

20 Claims, 5 Drawing Sheets

PENDULUM DEVICE

BACKGROUND OF THE INVENTION

The present invention relates to a pendulum device for actuating a decorative element in a clock or the like.

A conventional pendulum device is provided with a support member having a V-shaped edge for supporting a pendulum rod on an upper surface of a frame or support member of a clock movement. The pendulum rod is provided with a V-shaped groove which is placed on the V-shaped edge of the support member such that the pendulum rod rocks from side to side on the V-shaped edge. An anchor hook is formed on the pendulum rod and an anchor pin which can be engaged with the anchor hook is formed on the support member to lock the pendulum rod from rocking by engaging the anchor hook with the anchor pin when the pendulum device is not in use (see, e.g., Japanese Utility Model Publication No. Hei. 5-40471).

In another conventional pendulum device, an anchoring member which is capable of anchoring a portion of the pendulum rod is formed at a part of the support member for supporting the pendulum rod where the pendulum rod deviates from a normal rocking range thereof. The pendulum rod is locked from rocking by separating the V-shaped groove of the pendulum rod from the V-shaped edge of the support member by anchoring the portion to be anchored and the anchoring member to push up the portion to be anchored (see, e.g., Japanese Utility Model Publication No. Sho. 61-36950).

In another conventional pendulum device, an arm is formed so as to project from a side portion near a rocking fulcrum of the pendulum rod, and a receiving portion to which an end portion of the arm abuts when the rocking angle of the pendulum rod exceeds a normal rocking angle is formed on the support member for supporting the pendulum rod. When the end portion of the arm abuts with the receiving portion, the pendulum rod is displaced about the fulcrum of the end portion of the arm to separate the V-shaped groove of the pendulum rod from the V-shaped edge of the support member, thereby locking the pendulum rod by locking means (anchor hook and ratchet) in this separated state of the V-shaped groove and the V-shaped edge of the support member (see, e.g., Japanese Utility Model Publication No. Sho. 62-47106).

However, the conventional pendulum devices described above have a problem that their operability for locking/releasing the pendulum rod is inefficient, though the damage and wear of the V-shaped edge of the support member may be prevented because the V-shaped groove of the pendulum rod is held while being separated from the V-shaped edge of the support member in the state when the pendulum rod is locked from rocking. That is, the operation for locking/releasing the lock of the pendulum rod is cumbersome because the locking means for locking the pendulum rod from rocking is comprised of a pair of members (e.g., an anchor hook and an anchor pin) which engage with each other in a snap-fit manner.

Moreover, the operation for locking\releasing the pendulum rod in the conventional pendulum devices is complicated because it requires manipulating the pendulum rod directly by hand, which may cause damage thereto, and because a rear cover of the clock has to be removed in order to lock\release the pendulum rod. Furthermore, an excessive force is typically applied on the pendulum rod and the support member during a locking\releasing operation which may further damage these components.

SUMMARY OF THE INVENTION

It is therefore an object of the present invention to provide a pendulum device having a pendulum rod where operations for locking and releasing the pendulum rod are effectively performed without requiring the pendulum rod to be manipulated directly by hand.

It is a further object of the present invention to provide a pendulum device having a pendulum rod for use in a clock or the like which does not require removal of a rear cover of the clock in order to lock\release the pendulum rod.

It is another object of the present invention to provide a pendulum device having a pendulum rod and a locking mechanism which can reliably lock and release the pendulum rod.

It is another object of the present invention to provide a pendulum device having a pendulum rod in which detachment of the pendulum rod from the pendulum device when the pendulum rod is locked by the locking mechanism is prevented, thereby allowing transportation of the pendulum device to be carried out smoothly.

It is still a further object of the present invention to provide a pendulum device having a pendulum rod which does not require the application of an excessive force on the pendulum rod or a support member supporting the pendulum rod during locking\releasing operations of the pendulum rod.

The present invention accomplishes the above-described objects and others by providing a pendulum device comprising a pendulum rod, a support member having a support portion for rockably supporting the pendulum rod to permit the pendulum rod to rock freely within a desired or normal rocking angle, and a locking mechanism mounted on the support member for relative movement between first and second positions. The locking mechanism is operative in the first position to lock the pendulum rod from swinging freely and is operative in the second position to enable the pendulum rod to swing freely within the normal swinging angle. The locking mechanism has an operating portion which can be manipulated by a user to move the locking mechanism between the first and second positions. Retaining means is provided for retaining the locking mechanism at the first and second positions. When the locking mechanism is in the first position, an engaging portion of one of the pendulum rod and the locking mechanism engages with a receiving portion of the other of the pendulum rod and the locking mechanism, and the pendulum rod is separated from the support portion of the support member.

DETAILED DESCRIPTION OF THE PREFERRED EMBODIMENTS

The present invention will hereinafter be described in detail in accordance with embodiments shown in the accompanying drawings.

Figure 1:
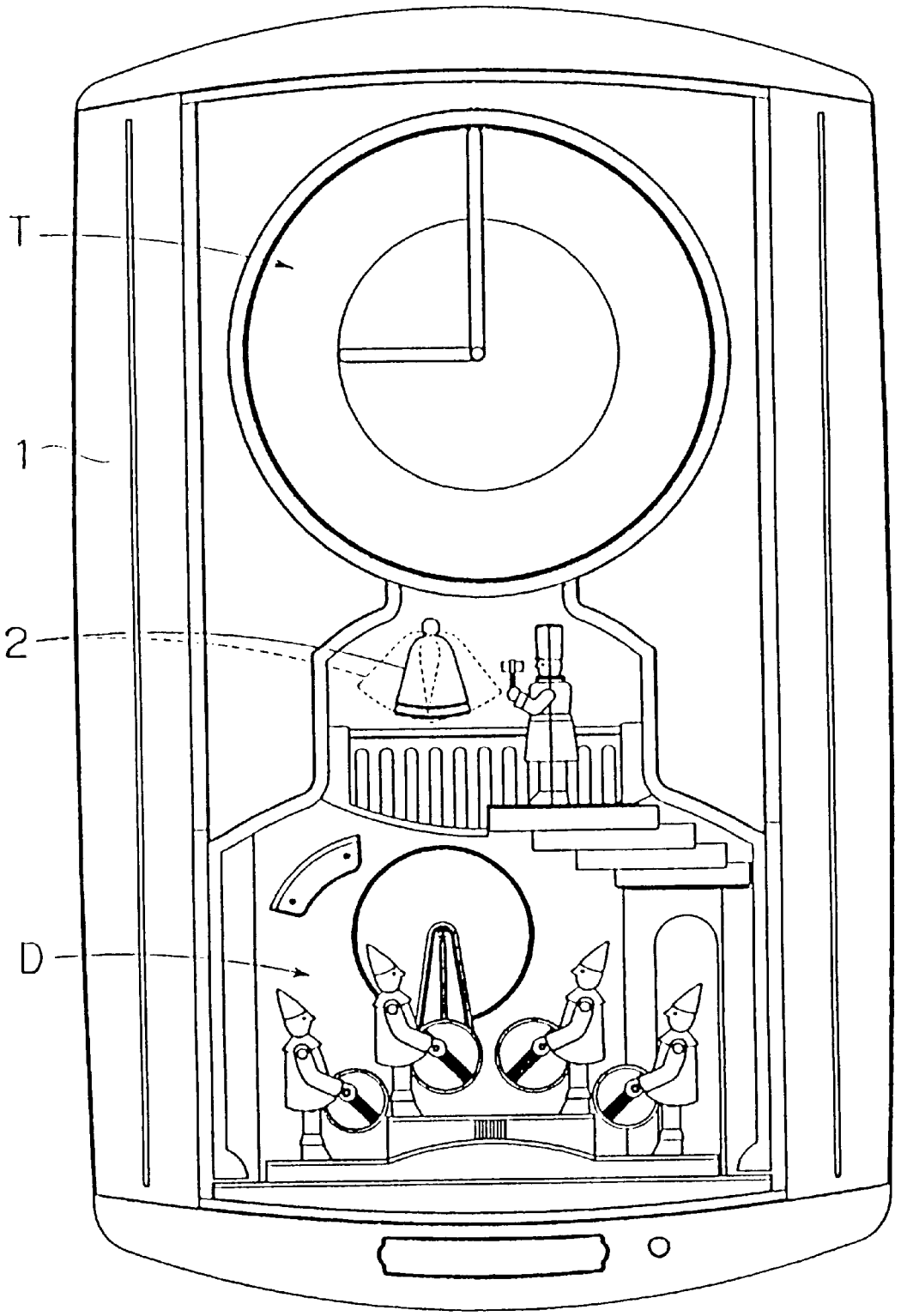
FIG. 1 is a front view of a clock equipped with a movable decoration and to which a pendulum device according to the present invention is applied.

FIG. 1 shows one example of a clock equipped with a movable decoration to which the inventive pendulum device is applied. A decoration or decorative element 2 in the shape of a bell, which is rocked or swung from side to side by a pendulum rod as described below, is provided nearly at the center of a front side of a support body or housing 1 below a time display portion T. Provided below the decoration 2 is an ornament member D comprised of four dolls which perform the action of turning disks at hourly intervals.

Figure 2:
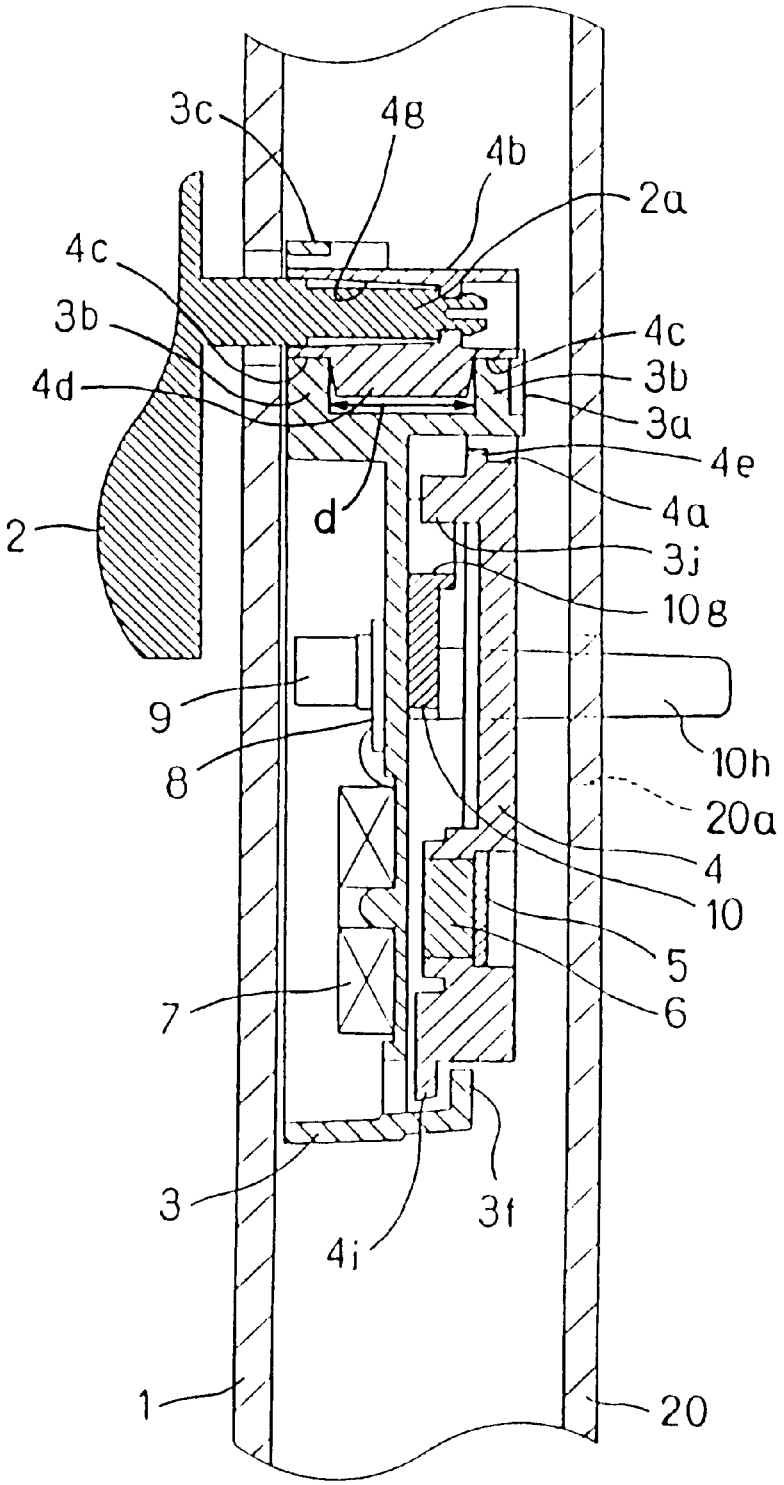
FIG. 2 is an enlarged cross-sectional view of a pendulum device according to one embodiment of the present invention.
Figure 3:
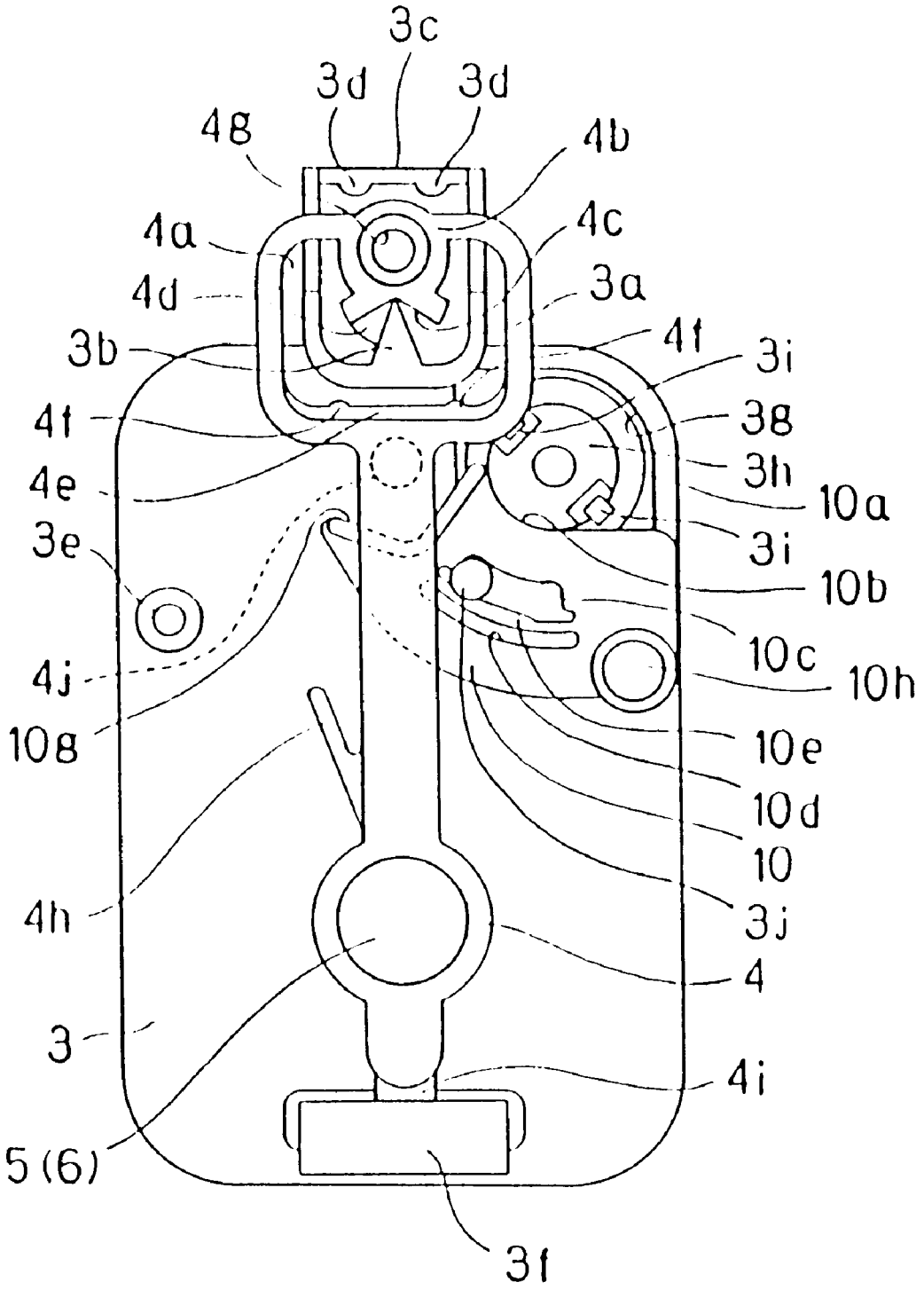
FIG. 3 is a rear view of the pendulum device in a state where the locking means is located at a releasing position.

As shown in FIGS. 2 and 3, a support member 3 for supporting a pendulum rod 4 in such a manner that it can freely swing rockably within a desired or normal swinging angle is secured on a rear surface of the housing 1 by fixing means such as screws (not shown). A U-shaped portion 3*a* extends horizontally between the housing 1 and a rear cover or case 20 of the housing and is formed at an upper end portion of the support member 3. The U-shaped portion 3*a* has a support portion having a pair of V-shaped projections 3*b*, 3*b* spaced apart from each other at a spacing d.

A frame provided with an opening 4*a* is formed at an upper end portion of the pendulum rod 4. A rocking or swinging center body 4*b* of the pendulum rod 4 is provided at an upper portion of the frame. V-shaped groove portions 4*c*, 4*c* which respectively engage with the V-shaped projections 3*b*, 3*b* are provided at opposing ends of the swinging center body 4*b*. A restricting or stopper portion 4*d* projects from the swinging center body 4*b* and is fitted loosely in the spacing d between the V-shaped groove portions 4*c*, 4*c*. By this construction, the pendulum rod 4 cannot be easily pulled out in the rightward direction as viewed in FIG. 2 unless it is swung at an angle which exceeds the normal swinging angle.

An arch portion 3*c* is formed at the upper end portion of the support member 3 while leaving a predetermined space between it and an outer upper surface of the swinging center body 4*b* as shown in FIGS. 2 and 3. A pair of circular projection portions 3*d*, 3*d* are formed to project from a lower surface of the arch portion 3*c*. A flange portion 4*e* is formed on an inner edge of the frame of the pendulum rod 4 while leaving a predetermined space between it and an outer lower surface of the U-shaped portion 3*a*. A pair of circular projection portions 4*f*, 4*f* are formed to project from an upper surface of the flange portion 4*e* as shown in FIG. 3. The space between the arch portion 3*c* and the swinging center body 4*b* is designed so that it is substantially equal to the space between the U-shaped portion 3*a* and the flange portion 4*e*.

As shown in FIG. 2, a decoration mounting hole 4*g* is formed at the upper end portion of the pendulum rod 4. A mounting portion 2*a* is formed so as to project from a rear surface of the decoration 2 and penetrate through the housing 1 and is coupled with the decoration mounting hole 4*g* via, for example, a snap-fit connection. By this construction, the decoration 2 can rock from side to side integrally with the pendulum rod 4 at the front side of the housing 1.

As shown in FIG. 3, a resilient arm 4*h* is formed integrally with a side portion of the pendulum rod 4. A projection portion 3*e* is provided at a side portion of a rear surface of the support member 3 for engagement with the resilient arm 4*h*. The resilient arm 4*h* is formed to have a size and shape such that it allows engagement with the projection portion 3*e* when the pendulum rod 4 swings to an extent that exceeds the normal swinging angle. Therefore, the pendulum rod 4 is always positioned within the normal swinging angle without separation of the pendulum rod 4 from the support member 3 beyond the stopper portion 4*d*.

A tongue portion 4*i* is formed so as to extend from a lower end portion of the pendulum rod 4, as shown in FIGS. 2 and 3. The tongue portion 4*i* is fitted idly within a regulating portion 3*f* which has an L-shaped section in side view and is formed at the center of the lower end portion of the support member 3. The tongue portion 4*i* and the regulating portion 3*f* restrict the lower end portion of the pendulum rod 4 from swinging back and forth (in the right-hand and left-hand directions shown in FIG. 2).

As best shown in FIG. 2, a yoke 5, preferably comprised of iron, is secured at the lower end portion of the pendulum rod 4. A permanent magnet 6 is magnetically attracted and supported by the yoke 5. A bobbin-less type coil 7 is mounted at the lower end portion of the support member 3 at a position opposing the permanent magnet 6. A circuit board 8 is mounted at a center portion of the support member 3, and an end of a wire of the coil 7 is connected to a predetermined circuit pattern (not shown) formed on the circuit board 8. Circuit elements 9, such as transistors, constituting a pendulum actuating circuit are mounted on the circuit board 8.

When the pendulum rod 4 is moved slightly from side to side by turning a power supply (not shown) ON to supply electric power to the circuit board 8, the permanent magnet 6 crosses in front of the coil 7. An induced electric power is generated in the coil 7 every time the permanent magnet 6 crosses in front of the coil 7, and a rocking force is given to the pendulum rod 4 by attraction and repulsion of the permanent magnet 6 through the control of the induced electric power. By repeating this action, the pendulum rod 4 is rocked from side to side about a fulcrum of the projections 3*b*, 3*b* and the decoration 2 is rocked from side to side integrally with the pendulum rod 4 at the front side of the housing 1.

Figure 4:
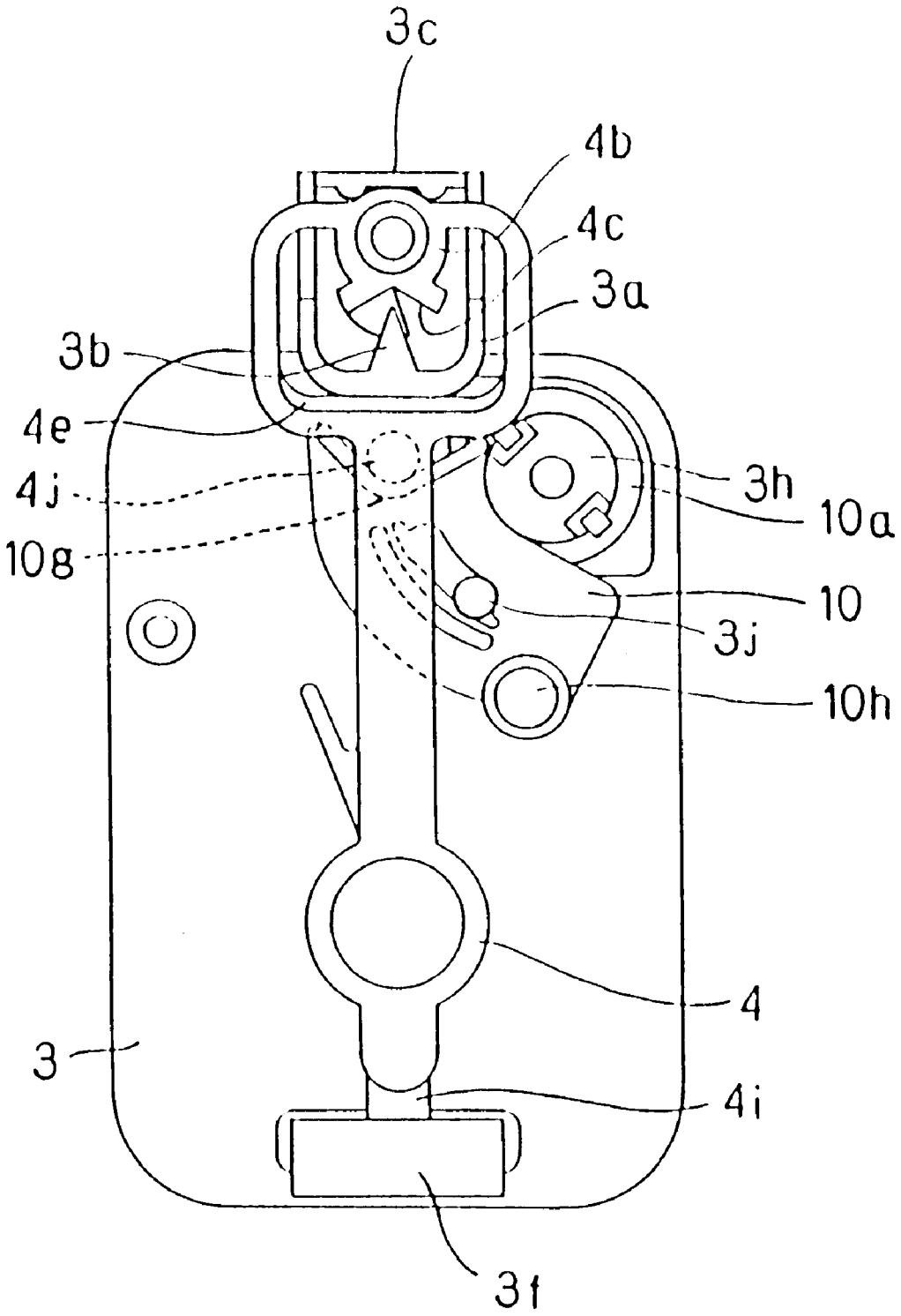
FIG. 4 is a rear view of the pendulum device in a state where the locking means is located at a locking position.

A locking mechanism 10 is rockably mounted on the support member 3 for relative movement between a releasing position (FIG. 3) and a locking position (FIG. 4). The locking mechanism 10 is operative in the locking position to lock the pendulum rod 4 from swinging freely and is operative in the releasing position to enable the pendulum rod to swing freely within the normal swinging angle.

As shown in FIG. 3, a cavity portion 3*g* is formed at the upper right-hand corner of a rear surface of the support member 3, and a ring portion 10*a* of the locking mechanism 10 is fitted in a cylindrical portion 3*h* disposed within the cavity portion 3*g*. An inner surface 10*b* of the ring portion 10*a* of the locking mechanism 10 is anchored by a pair of snap-fit pawls 3*i* formed on the side of the cylindrical portion 3*h*. By this construction, the locking mechanism 10 is capable of rocking freely in front of the support member 3 centering on the ring portion 10*a*.

Two arcuate slits 10*c* and 10*d* which are concentric with the center of rock of the locking mechanism 10 are formed on the locking mechanism 10. A positioning pin 3*j* disposed in front of the support member 3 is fitted within the slit 10*c*. An arcuate arm portion 10*e* which separates the slits 10*c* and 10*d* is formed having root or end portions thereof which are thinner than other portions thereof. The slit 10*c* has a width equal in dimension to a diameter of the positioning pin 3*g* at both end portions thereof. The positioning pin 3*j* and the slits 10*c* and 10*d* serve as retaining means for retaining the locking mechanism 10 at the releasing position (FIG. 3) and the locking position (FIG. 4).

When the locking mechanism 10 is rocked from the releasing position shown in FIG. 3 to the left, the positioning pin 3*j* positioned at the left edge of the slit 10*c* moves in the rightward direction within the slit 10*c* while deflecting the arm portion 10*e* toward the slit 10*d* and is positioned at the right edge of the slit 10*c*. Then, the locking mechanism 10 stops at the locking position shown in FIG. 4.

A receiving portion log is formed at the left edge of the locking mechanism 10. The receiving portion log can engage with an engaging portion or pin 4*j* formed so as to project from the back of the pendulum rod 4 when the locking mechanism 10 is at the locking position (FIG. 4). It is noted that the receiving portion log is generally V-shaped and is capable of engaging with the pin 4*j* at any position so long as the pendulum rod 4 rocks within the normal rocking angle.

As shown in FIGS. 2 and 3, an operating knob portion 10*h* for controlling the rocking motion of the locking mechanism 10 is formed so as to project from a lower right-hand portion of the locking mechanism 10. The operating knob portion 10*h* projects through a slit 20*a* of the case 20 (e.g., rear case of a clock) to the outside as shown in FIG. 2 so that a user can lock the pendulum rod 4 by displacing (i.e., rocking) the locking mechanism 10 without touching the pendulum rod (e.g., by pinching it) directly by hand.

Next, the operation for locking the pendulum rod 4 will be explained. When the locking mechanism 10 is placed at the rightmost position (releasing position) centering on the ring portion 10*a* thereof as shown in FIG. 3, the pin 4*j* of the pendulum rod 4 and the receiving portion 10*g* of the locking mechanism 10 are separated and the pendulum rod 4 is capable of freely swinging rockably from side to side centering on the swinging center body 4*b* thereof. When the locking mechanism 10 is displaced or rocked in the leftward direction from the releasing position shown in FIG. 3, the positioning pin 3*j* located at the left end of the slit 10*c* moves in the rightward direction within the slit 10*c* while deflecting the arm portion 10*e* toward the slit 10*d* side. When the receiving portion 10*g* of the locking mechanism 10 engages with the pin 4*j* of the pendulum rod 4 as the locking mechanism 10 is continued to be displaced in the leftward direction from the releasing position, the pendulum rod 4 is pushed upward by the receiving portion 10*g* of the locking mechanism and the engagement between the projections 3*b*, 3*b* and the V-shaped groove portions 4*c*, 4*c* is released. When the locking mechanism 10 is displaced further in the leftward direction, the positioning pin 3*j* is positioned at the right end of the slit 10*c*, the locking mechanism 10 is held at the locking position shown in FIG. 4 and the pendulum rod 4 moves to an uppermost vertical position. At this point, the outer upper surface of the swinging center body 4*b* abuts in point contact with the circular projection portions 3*d*, 3*d* at the lower surface of the arch portion 3*c*, and the pair of circular projection portions 4*f*, 4*f* at the upper surface of the flange portion 4*e* abut in point contact with the outer lower surface of the U-shaped portion 3*a*. In this state, the pendulum rod 4 is locked in the uppermost vertical position and is not capable of freely swinging rockably from side to side.

The pendulum rod 4 may be released from the locking position shown in FIG. 4 by rocking the locking mechanism 10 in the rightward direction to the releasing position shown in FIG. 3. At this point, the pendulum rod 4 falls naturally by its own weight such that each of the projections 3*b*, 3*b* engages with one of the V-shaped groove portions 4*c*, 4*c* and the pendulum rod 4 is allowed to freely rock.

It will be appreciated by those of ordinary skill in the art that because the receiving portion 10*g* is generally V-shaped, the receiving portion 10*g* can engage with the pin 4*j* at any position so long as the pendulum rod 4 is positioned within the normal rocking angle. Accordingly, the pendulum rod 4 may be always locked accurately even if the pendulum rod 4 is not positioned vertically (i.e., even if the pendulum rod 4 is at any angular position within the normal rocking angle).

It will also be appreciated by those of ordinary skill in the art that since the tongue portion 4*i* formed at the lower end portion of the pendulum rod 4 is idly or loosely fitted within the regulating portion 3*f* formed at the center of the lower end of the support member 3 both in the releasing position shown in FIG. 3 and in the locking position 4 shown in FIG. 4, the pendulum rod 4 is restricted from detachment by movement in the rightward direction in FIG. 2. Similarly, when an upward force is applied on the pendulum rod 4 in FIGS. 3 and 4, the circular projection portions 4*f*, 4*f* are brought into contact with the outer lower surface of the U-shaped portion 3*a*, and the outer upper surface of the swinging center body 4*b* is brought into contact with the circular projection portions 3*d*, 3*d*. Consequently, the circular projection portions 3*d*, 3*d*, the swinging center body 4*b*, the circular projection portions 4*f*, 4*f* and the U-shaped portion 3*a* serve as a restricting means, whereby upwardly detachment of the pendulum rod 4 is restricted.

Figure 5:
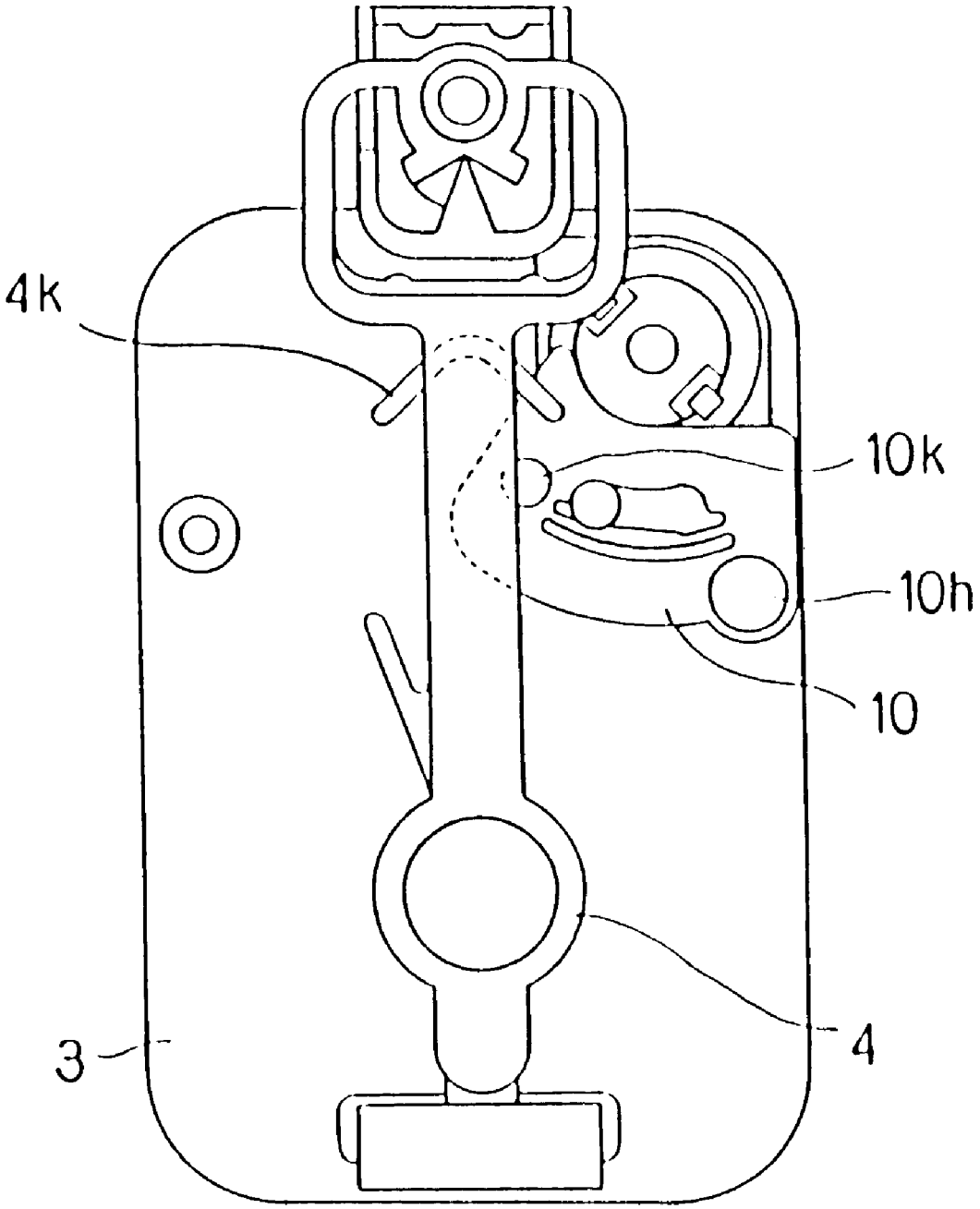
FIG. 5 is a rear view of a pendulum device according to another embodiment of the present invention.

Another embodiment of the present invention, as shown in FIG. 5, comprises the elements described above with respect to the embodiment of FIGS. 2–4. However, in the embodiment of FIG. 5, a receiving portion 4*k* having a generally V-shaped configuration is provided on a rear surface of the pendulum rod 4, and an engaging portion or pin 10*k* which engages with the receiving portion 4*k* is formed on the left side of the locking mechanism 10. The procedure for locking and releasing the pendulum rod 4 is as described above for the embodiment of FIGS. 1–4.

In the embodiments of FIGS. 2–4 and 5, although the structure described is one in which the projections 3*b*, 3*b* are provided in the U-shaped portion 3*a*, and the V-shaped groove portions 4*c*, 4*c* are provided in the swinging center body 4*b*, the projections 3*b*, 3*b* may be provided in the swinging center body 4*b*, and the V-shaped groove portions 4*c*, 4*c* may be provided in the U-shaped portion 3*a*.

The present invention is carried out in the embodiments described above and exhibits the following effects.

The locking mechanism for locking and releasing the pendulum rod is rockably supported by the support member supporting the pendulum rod and is provided with an operating knob portion which projects through a rear case (e.g., of a clock) to the outside as shown in FIG. 2 so that a user can lock the pendulum rod by displacing (i.e., rocking) the locking mechanism without touching the pendulum rod (e.g., by pinching it) directly by hand. By this construction, an excessive force is not applied to the pendulum rod and the support member during a locking\releasing operation and there is no possibility that the pendulum rod is damaged as with conventional pendulum devices.

The locking mechanism and the support member include retaining means for retaining the locking mechanism at the locking and releasing positions. By this construction, the pendulum rod is securely and effectively locked and released, thereby providing for an effective operation of the pendulum device.

The engaging portion provided on one of the pendulum rod and the locking mechanism is constructed so as to engage with the receiving portion provided on the other of the pendulum rod and the locking mechanism when the locking mechanism is at the locking position. By this construction, the pendulum rod may be locked from swinging rockably in a reliable and stable manner, allowing transportation of the pendulum device to be carried out smoothly.

The pendulum device is constructed so that the V-shaped groove portions of the pendulum rod are disengaged from the projections of the support member in the locking position of the locking mechanism. By this construction, it is possible to prevent a load from being applied to the V-shaped groove portions of the pendulum rod and the projections of the support member, and therefore prevent damage thereto, when the locking mechanism is in the locking position.

Since the receiving portion provided on one of the locking mechanism and the pendulum rod is generally V-shaped, the receiving portion can engage with the engaging portion provided on the other of the locking mechanism and the pendulum rod at any position so long as the pendulum rod is positioned within the normal rocking angle. Accordingly, the pendulum rod can always be locked accurately even if the pendulum rod is not positioned vertically (i.e., even if the pendulum rod is at any angular position within the normal rocking angle).

We claim:

1. A pendulum device comprising: a pendulum rod; a support member for rockably supporting the pendulum rod to permit the pendulum rod to swing freely within a normal swinging angle; and locking means mounted on the support member for relative movement between first and second positions, the locking means being operative in the first position to lock the pendulum rod from swinging freely and being operative in the second position to enable the pendulum rod to swing freely within the normal swinging angle.

2. A pendulum device according to claim 1; further comprising retaining means for retaining the locking means at the first and second positions.

3. A pendulum device according to claim 2; wherein the retaining means comprises a slot provided in the locking means and having first and second end portions, and a positioning pin provided on the support member for engagement with the first and second end portions of the slot when the locking means is moved between the first and second positions, respectively.

4. A pendulum device according to claim 3; wherein the slot is arcuate in shape to permit the locking means to swing rockably between the first and second positions.

5. A pendulum device according to claim 1; wherein the locking means comprises a receiving portion disposed at one of the pendulum rod and the locking means, and an engaging portion disposed at the other of the pendulum rod and the locking means for engaging the receiving portion when the locking means is in the first position.

6. A pendulum device according to claim 5; wherein the support member comprises a support portion for engagement with the pendulum rod when the locking means is in the second position and for disengagement from the pendulum rod when the locking means is in the first position.

7. A pendulum device according to claim 5; wherein the receiving portion is generally V-shaped.

8. A pendulum device according to claim 1; wherein the locking means comprises an operating knob portion for moving the locking means between the first and second positions.

9. A pendulum device according to claim 1; wherein the pendulum rod has a longitudinal axis and is supported by the support member for free swinging motion about a swinging axis disposed perpendicular to the longitudinal axis and within the normal swinging angle.

10. A pendulum device according to claim 9; further comprising first restricting means for restricting the pendulum rod from detaching in the longitudinal direction thereof, and second restricting means for restricting the pendulum rod from detaching in the direction of the swinging axis.

11. A pendulum device comprising: a pendulum rod having a longitudinal axis; a support member; means mounting the pendulum rod on the support member for swinging motion about a swinging axis disposed perpendicular to the longitudinal axis and within a desired swinging angle; and locking means mounted on the support member for relative movement between first and second positions, the locking means being operative in the first position to lock the pendulum rod from swinging motion and being operative in the second position to enable the pendulum rod to swing freely within the desired swinging angle.

12. A pendulum device according to claim 11; wherein the locking means comprises a receiving portion provided at one of the pendulum rod and the locking means, and an engaging portion provided at the other of the pendulum rod and the locking means for engaging the receiving portion when the locking means is in the first position.

13. A pendulum device according to claim 12; wherein the support member comprises a support portion for engagement with the pendulum rod when the locking means is in the second position and for disengagement from the pendulum rod when the locking means is in the first position.

14. A pendulum device according to claim 12; wherein the receiving portion is generally V-shaped.

15. A pendulum device according to claim 11; wherein the locking means comprises an operating knob portion for moving the locking means between the first and second positions.

16. A pendulum device according to claim 11; wherein the mounting means comprises a center body disposed on a portion of the pendulum rod, and a support portion disposed on the support member; wherein one of the center body and the support portion has a pair of V-shaped projections spaced apart at a given distance, and wherein the other of the center body and the support portion has a pair of V-shaped groove portions engageable with the V-shaped projections.

17. A pendulum device according to claim 16; further comprising means for restricting movement of the pendulum rod along the swinging axis relative to the support member when the pendulum rod is within the desired swinging angle to prevent detachment thereof and for enabling free movement of the pendulum rod along the swinging axis when the pendulum rod exceeds the desired swinging angle to permit detachment thereof.

18. A pendulum device according to claim 17; wherein the means for restricting movement along the swinging axis comprises a restricting portion provided on the other of the center body and the support portion and disposed between the V-shaped projections, and a guide groove in the restricting portion which connects the V-shaped grooves and which is positioned to allow the projections to pass when the pendulum rod is swung beyond the desired swinging angle.

19. A pendulum device comprising: a support body; a case mounted to the support body to define an enclosure; a support member disposed in the enclosure and fixed to the support body; a pendulum rod having a longitudinal axis and mounted on the support member for swinging motion about a swinging axis perpendicular to the longitudinal axis and within a desired swinging angle; and a locking mechanism mounted on the support member for relative movement between first and second positions, the locking mechanism being operative in the first position to lock the pendulum rod from swinging motion and being operative in the second position to enable the pendulum rod to swing freely within the desired swinging angle.

20. A pendulum device according to claim 19; wherein the locking mechanism has an operating portion which projects through the case outside of the enclosure for moving the locking mechanism between the first and second positions.

* * * * *